US011503684B2

(12) United States Patent
Li et al.

(10) Patent No.: US 11,503,684 B2
(45) Date of Patent: Nov. 15, 2022

(54) LIGHT EMITTING DIODE LUMINAIRES WITH TEMPERATURE FEEDBACK

(71) Applicant: LEDVANCE LLC, Wilmington, MA (US)

(72) Inventors: Ming Li, Acton, MA (US); Yuhao Liu, Andover, MA (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 16/937,945

(22) Filed: Jul. 24, 2020

(65) Prior Publication Data

US 2022/0030685 A1 Jan. 27, 2022

(51) Int. Cl.

| | |
|---|---|
| ***H05B 45/28*** | (2020.01) |
| ***H05B 45/325*** | (2020.01) |
| ***F21K 9/232*** | (2016.01) |
| ***F21K 9/238*** | (2016.01) |
| *F21V 29/70* | (2015.01) |
| *F21Y 115/10* | (2016.01) |
| *F21Y 113/10* | (2016.01) |

(52) U.S. Cl.

CPC ..... *H05B 45/28* (2020.01); *F21K 9/232* (2016.08); *F21K 9/238* (2016.08); *H05B 45/325* (2020.01); *F21V 29/70* (2015.01); *F21Y 2113/10* (2016.08); *F21Y 2115/10* (2016.08)

(58) Field of Classification Search

CPC ..... H05B 45/20; H05B 45/28; H05B 45/30; H05B 45/325; F21K 9/238; F21K 9/232

See application file for complete search history.

(56) References Cited

U.S. PATENT DOCUMENTS

| | | | | |
|---|---|---|---|---|
| 10,098,197 | B2 * | 10/2018 | van de Ven | H05B 45/28 |
| 2010/0259182 | A1 * | 10/2010 | Man | H05B 45/22 315/250 |
| 2011/0068696 | A1 * | 3/2011 | van de Ven | H05B 45/48 315/152 |
| 2011/0211351 | A1 * | 9/2011 | Van De Ven | F21K 9/27 362/249.02 |
| 2012/0033429 | A1 * | 2/2012 | Van De Ven | H05B 45/30 362/294 |

(Continued)

OTHER PUBLICATIONS

James R. Pryde, "Development of effective thermal management strategies for LED luminaires", Doctoral Thesis for Loughborough University.

*Primary Examiner* — Thai Pham

(74) *Attorney, Agent, or Firm* — Tutunjian & Bitetto PC

(57) ABSTRACT

The present disclosure provides methods and structures for controlling characteristics of light being projected from a light source. In one embodiment, the method includes selecting a color setting of light to be projected by a light engine having at least one light emitting diode; and monitoring temperature of the light engine with a thermistor. The changes in resistance measurements taken from the thermistor are correlated to changes in the temperature of the light engine. The method for controlling characteristics of light being projected from the light source may further include setting characteristics of the electrical signal to energize the light emitting diodes of the light engine to provide the color setting selected at the temperature of the light engine measured using the thermistor.

7 Claims, 9 Drawing Sheets
(1 of 9 Drawing Sheet(s) Filed in Color)

(56) References Cited

U.S. PATENT DOCUMENTS

| | | | | |
|---|---|---|---|---|
| 2013/0077299 | A1* | 3/2013 | Hussell | H05B 47/10 362/249.02 |
| 2016/0334091 | A1* | 11/2016 | Kim | F21V 29/61 |
| 2017/0056686 | A1* | 3/2017 | Gamelin | H02J 7/0021 |
| 2019/0338895 | A1* | 11/2019 | Jeswani | F21V 23/04 |

* cited by examiner

LIGHT EMITTING DIODE LUMINAIRES WITH TEMPERATURE FEEDBACK

TECHNICAL FIELD

The present disclosure generally relates to methods and structures that incorporate light emitting devices (LEDs). More particularly, the present disclosure provides an RGBW luminaire including a light engine including light emitting diodes (LEDs).

BACKGROUND

Improvements in lighting technology often rely on finite light sources (e.g., light-emitting diode (LED) devices) to generate light. In many applications, LED devices offer superior performance to conventional light sources (e.g., incandescent and halogen lamps). Further, light bulbs have become smarter in recent years. Many people are now replacing their standard incandescent bulb or classic LED bulb with smart bulb, which can be controlled wirelessly using smartphones or tablets. In addition, colored LEDs, such as red, green, blue and white (RGBW), or red, green, blue and lime (RGBL) offer an opportunity to end users to pick different colors by color mixing.

SUMMARY

In one embodiment, the present disclosure provides a method of controlling characteristics of light being projected from a light source. In one embodiment, the method includes selecting a color setting of light to be projected by a light engine having at least one light emitting diode; and monitoring temperature of the light engine with a thermistor. The changes in resistance measurements taken from the thermistor are correlated to changes in the temperature of the light engine. The method for controlling characteristics of light being projected from the light source may further include setting characteristics of the electrical signal to energize the light emitting diodes of the light engine to provide the color setting selected at the temperature of the light engine measured using the thermistor.

In another aspect of the present disclosure, a lamp is provided that includes a light engine having a least one light emitting diode. The lamp further includes an interface through which the lighting characteristics for light being projected by the light emitting diode may be selected. In some embodiments, the lamp further includes a thermistor sensing circuit, wherein the thermistor sensing circuit monitors the temperature of the light engine. The lamp may also include a controller that monitors temperature of the light engine with a thermistor, wherein changes in resistance measurements taken from the thermistor are correlated to changes in the temperature of the light engine. The controller can further configure the electrical signal to energize the light emitting diodes of the light engine to provide the color setting selected at the temperature of the light engine measured using the thermistor.

In yet another aspect of the present disclosure, a lamp is provided that includes a light engine having a least one light emitting diode. The lamp further includes an interface through which lighting characteristics for light being projected by the light emitting diode may be selected. The lighting characteristic that are selected include X, Y, and Z scale values of the International Commission (CIE) 1931 XYZ color space. In some embodiments, the lamp further includes a thermistor sensing circuit, wherein the thermistor sensing circuit monitors the temperature of the light engine. The lamp further includes memory for storing a plurality of light settings that correlate temperature to pulse width modulation (MWM) values applied to the at least one light emitting diode of the light engine to provide colored light having X, Y and Z scale values from the International Commission (CIE) 1931 XYZ color space. The lamp may also include a controller that monitors temperature of the light engine with a thermistor sensing circuit, wherein changes in resistance measurements taken from the thermistor sensing are correlated to changes in the temperature of the light engine. Based on the temperature of the light engine measured using the thermistor sensing circuit, the controller can further select one of said plurality of light settings that correlate temperature to pulse width modulation (MWM) values applied to the at least one light emitting diode of the light engine to provide colored light having X, Y and Z scale values from the International Commission (CIE) 1931 XYZ color space for the light characteristic that was selected at the temperature of the light engine that was measured.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following description will provide details of embodiments with reference to the following figures wherein:

FIG. 1(*b*) is a plot of the luminous flux vs temperature of InGaN Lime LEDs.

DETAILED DESCRIPTION

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

Figure 1A:
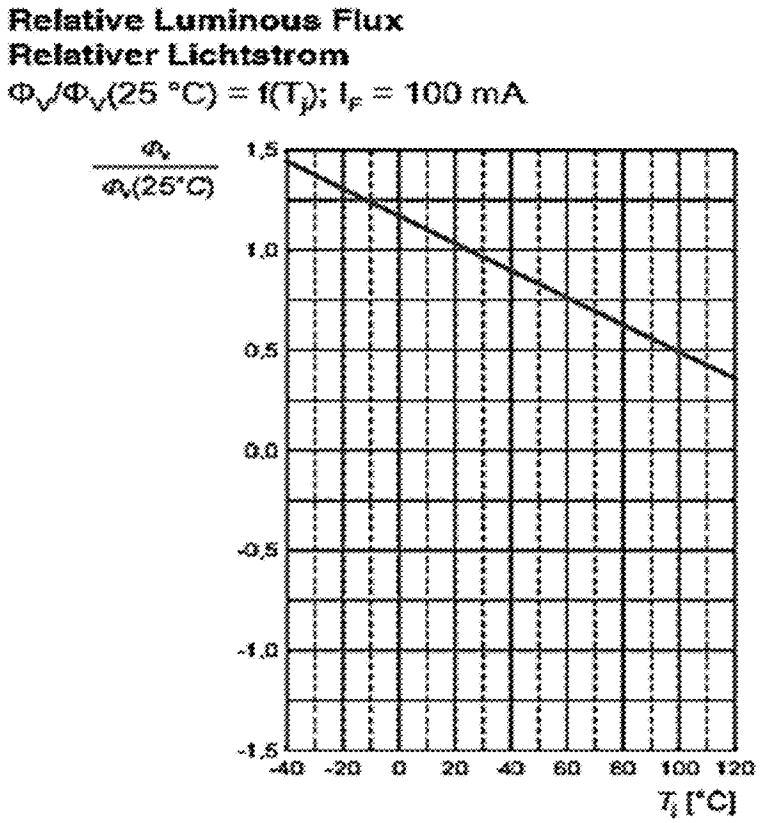
FIG. 1(*a*) is a plot of the luminous flux vs temperature of InGaAlP red LEDs.
Figure 1B:
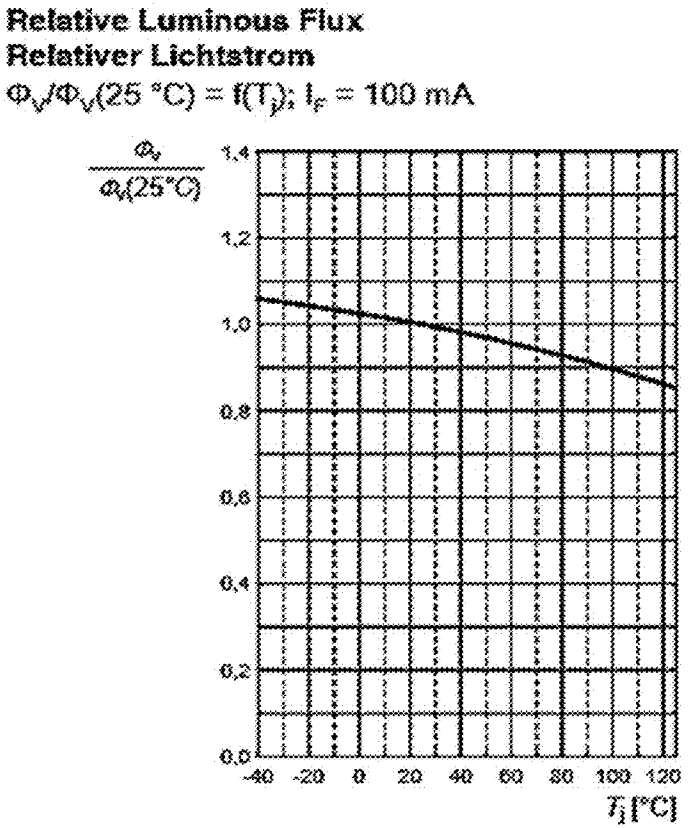

There are a growing number of red, green, blue, white (RGBW) light emitting diode (LED) lamps in the market. For example, if green, red and blue LEDs are picked for color mixing, one color within the gamut (the triangle defined by these 3 colors) can generated by mixing different dosage of colors (i.e. adjusting the currents running through different types of LEDs). While obtaining different colors is generally not difficult, it is difficult to deliver the right color. The LED output, or luminous flux, is a function of its junction temperature. For example, non phosphor converted red LEDs (InGaAlP) have very strong temperature dependence, shown in FIG. 1(*a*); and phosphor converted lime LEDs (InGaN) have relatively weak dependence on temperature, shown in FIG. 1(*b*). Therefore, when ambient temperature and LED temperatures change, the luminous outputs of LEDs will change accordingly. It has been determined that to consistently deliver the right color, a lamp design needs to compensate this effect by adjusting current to the light engine.

One common practice is to assume the RGBW lamp operates mostly at certain ambient operation temperature. For example, some lamp designs are calibrated to operate at a temperature of 40° C. In this case, when the lamp is operating at the calibration temperature, the color of the lamp is quite accurate this temperature. The disadvantage of this method is that the color will be off quite a bit when the ambient temperature is significantly lower or higher than the preset calibration temperature.

The methods, systems and computer program products that are described herein introduce new hardware, e.g., a thermal feedback system, and color calibration methods that solve the accuracy problems that result from variations in temperature at which light emitting diodes (LEDs) operate. As will be further described herein, the method and apparatus for RGBW color LED lamps with temperature feedback provides a low cost solution to temperature based variation. In some examples, the low cost solution may include the introduction of hardware, such as a thermistor, to a lamp system for the purpose of providing a temperature feedback indicative of operating temperature of the LED light source. A "thermistor" is a type of resistor whose resistance is dependent on temperature, more so than in standard resistors. Thermistors are a type of semiconductor, meaning they have greater resistance than conducting materials, but lower resistance than insulating materials. The relationship between a thermistor's temperature and its resistance is highly dependent upon the materials from which it's composed.

The methods, systems and computer program products that are described herein introduce new color calibration methods that solve the accuracy problems that result from variations in temperature. In some embodiments, the method employs an algorithm that considers the system temperature and users' input (e.g., input for color selection) for a desired light characteristic output into consideration when powering the light emitting diodes (LEDs) of the light engine. In some embodiments, by employing the structures and methods of the present disclosure lighting systems can be provided, in which the output color and lumens of light being emitted always meet the standards sought by the user regardless of the operation condition, e.g., temperature conditions. The methods, systems and computer program products are now described in greater detail with reference to FIGS. 1*a*-11.

Figure 2:
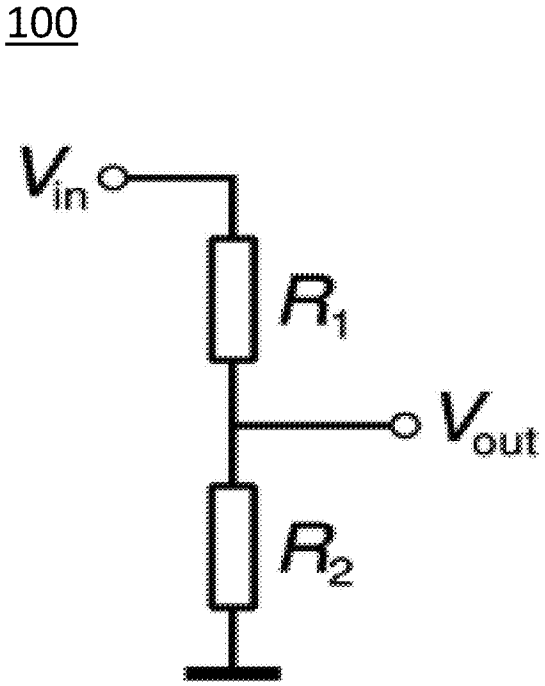
FIG. 2 illustrates one embodiment of a circuit diagram for the hardware for temperature monitoring in a lamp including a light emitting diode (LED) light engine, in accordance with one embodiment of the present disclosure.
Figure 3:
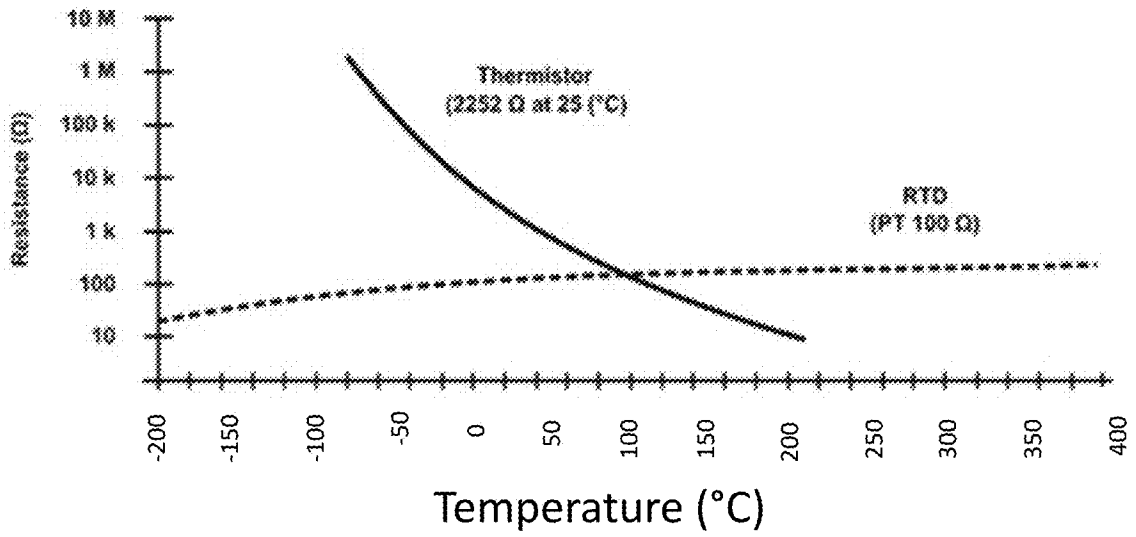
FIG. 3 is a plot depicting the temperature sensitivity coefficient of a negative temperature coefficient thermistor (NTC), as used in one embodiment of the present disclosure.

FIG. 2 illustrates one embodiment of a circuit diagram for the hardware for temperature monitoring in a lamp including a light emitting diode (LED) light engine, e.g., red, green, blue, white (RGBW) light emitting diode (LED) light engine, or red, green, blue, lime (RGBL) light emitting diode (LED) light engine. The hardware for temperature monitoring may be referred to as a thermistor sensing setup, or thermistor sensor 100. The thermistor sensor 100 may include a fixed resistor R1 and a negative temperature coefficient thermistor (NTC) R2. A negative temperature coefficient thermistor (NTC) R2 is a resistor with a negative temperature coefficient, which means that the resistance decreases with increasing temperature. An NTC thermistor is a thermally sensitive resistor whose resistance exhibits a large, precise and predictable decrease as the core temperature of the resistor increases over the operating temperature range. The temperature sensitivity coefficient for the negative temperature coefficient thermistor (NTC) R2 is about five times greater than that of silicon temperature sensors (silistors) and about ten times greater than those of resistance temperature detectors (RTDs). In some embodiments, the negative temperature coefficient thermistor (NTC) R2 has a temperature sensitivity coefficient as depicted in FIG. 3. In some embodiments, the temperature range of the negative temperature coefficient thermistor (NTC) R2 can range from −55° C. to 200° C. In one example, the temperature range of the negative temperature coefficient thermistor (NTC) R2 can range from −10° C. to 85° C.

The NTC thermistor R2 is generally made of ceramics or polymers. Using different materials in the NTC thermistor R2 can result in different temperature responses, as well as other characteristics. Thermistors are made up of metallic oxides, binders, and stabilizers, pressed into wafers and then cut to chip size, left in disc form, or made into another shape. The precise ratio of the composite materials governs their resistance/temperature "curve".

In some embodiments, the negative temperature coefficient thermistor (NTC) R2 is directly mounted onto a metal core of a printed circuit board (PCB), which also house the light emitting diodes (LEDs) that provide the light sources for the light engine 200. For example, the light emitting diodes (LEDs) of the light engine 200 may be arranged to provide a red, green, blue, and lime (RGBL) light emitting diode (LED) arrangement.

As noted, the design further includes a fixed resistor R1. Fixed resistors R1 are the resistors whose resistance does not change with the change in voltage or temperature. The fixed resistor R1 may be a carbon film type resistor, a metal film resistor, a surface mount resistor or a combination thereof.

The fixed resistor R1 may have a resistance ranging from 5 k ohm to 15 k ohm. In one example, the fixed resistor R1 has a value of 10 k ohm.

Referring to FIG. 2, the assembly of the fixed resistor R1 and the NTC thermistor R2 has a voltage input (Vin). The voltage input (Vin) may be fixed. In some embodiments, the voltage input may be fixed at a value selected from the voltage ranging from 2.0V to 3.5V. In one example, the voltage input (Vin) is equal to 3.3V. The voltage of voltage output (Vout) from the thermistor sensing setup, or thermistor sensor 100, is to be monitored by the system. Using the voltage out (Vout), the resistance of the NTC thermistor R2 can be measured, which is a good indicator of temperature of the light source. The negative temperature coefficient thermistor (NTC) R2 is positioned on the light source. More specifically, in some embodiments, the negative temperature coefficient thermistor (NTC) R2 is directly mounted to a metal core of the printed circuit board (PCB), and the light emitting diodes (LEDs) of the light source are directly mounted to the printed circuit board (PCB). The terms "positioned on" means that a first element, such as a first structure, is present on a second element, such as a second structure, wherein intervening elements, such as an interface structure, e.g. interface layer, may be present between the first element and the second element. The term "direct contact" or "directly mounted" means that a first element, such as a first structure, and a second element, such as a second structure, are connected without any intermediary conducting, insulating or semiconductor layers at the interface of the two elements.

Because the negative temperature coefficient thermistor (NTC) R2 is mounted on the substrate of the light engine, e.g., mounted into direct contact with the metal core of the printed circuit board that provides the substrate for the light emitting diodes (LEDs) of the light engine, the changes in temperature that the light emitting diodes (LEDs) experience are also experienced by the negative temperature coefficient thermistor (NTC) R2. In response to the temperature changes that are experienced by the negative temperature coefficient thermistor (NTC) R2, the resistance of the negative temperature coefficient thermistor (NTC) R2 changes. From measuring those changes in the resistance of the negative temperature coefficient thermistor (NTC) R2, the temperature of the light emitting diodes (LEDs) can also be measured.

Figure 4:
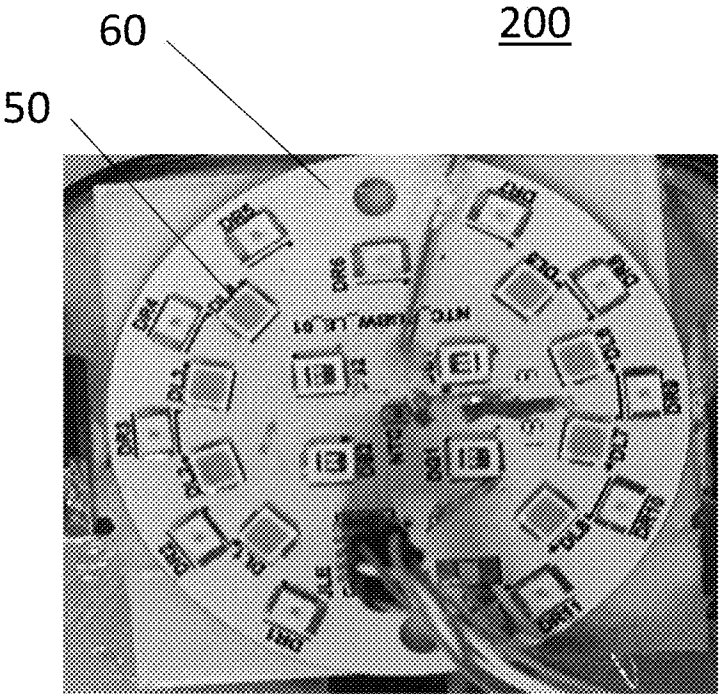
FIG. 4 is a perspective view of a light engine for use with the hardware for monitoring temperature in lamps that is illustrated in FIG. 2, in accordance with one embodiment of the present disclosure.

FIG. 4 depicts one embodiment of a light engine for use with the hardware for monitoring temperature in lamps that is illustrated in FIG. 2. The light engine produces light from solid state emitters. The term "solid state" refers to light emitted by solid-state electroluminescence, as opposed to incandescent bulbs (which use thermal radiation) or fluorescent tubes, which use a low pressure Hg discharge. Compared to incandescent lighting, solid state lighting creates visible light with reduced heat generation and less energy dissipation. Some examples of solid-state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid-state light emitters are provided by light emitting diodes, any of the aforementioned solid state light emitters may be substituted for the LEDs.

Referring to FIG. 4, in some embodiments, the light source for the light engine 200 are provided by a plurality of LEDs 50 that can be mounted to the circuit board 60 by solder, a snap-fit connection, or other engagement mechanisms. In some examples, the LEDs 50 are provided by a plurality of surface mount device (SMD) light emitting diodes (LED).

The circuit board 60 for the light engine may be composed of a metal core printed circuit board (MCPB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy. In some embodiments, other materials, such as FR4 can also be employed. As noted above, the thermistor sensing setup, or thermistor sensor 100, includes a negative temperature coefficient thermistor (NTC) R2 that is positioned at the back surface of the circuit board 60 (opposite the surface of the circuit board 60 that is the light emitting end, e.g., has the LEDs attached thereto) and is in direct contact with the metal core of the circuit board 60.

It is noted that the number and type of light emitting diodes (LEDs) 50 on the printed circuit board 60 may vary. In some embodiments, the light engine may include four different types of light emitting diodes (LEDs) 50 that are present on the printed circuit board 60, in which the four different types of LEDs 50 may have the colors of red, green, blue and mint/lime. It is noted that the colors for the light emitting diodes (LEDs) on the printed circuit board 60 may provide a red, green, blue, white (RGBW) light emitting diode (LED), or the colors of the light emitting diodes (LEDs) on the printed circuit board 60 may provide a red, green, blue, lime (RGBL) light emitting diode (LED).

A string of light emitting diodes (LEDs) can be of a single color, or a string of light emitting diodes (LEDs) may include multiple LED types of different colors. The light engine can include any number of strings of LEDs. The power to energize the LEDs on a single string of LEDs is individually addressable. This provides that the power to each LED string can be adjusted to be different. For example, the current to one LED string may be different to the current to a second LED string in the light engine 200. As described herein, the power, e.g., current, to the strings of LEDS can be adjusted to each LED string to provide adjustments responsive to temperature changes in providing a selected lighting characteristic, e.g., color.

In one example, the outmost circle of the light engine 200 may include 11 red light emitting diodes (LEDs), the second outermost circle may include 8 lime light emitting diodes (LEDs), and the center of the light engine may include 4 blue and green light emitting diodes (LEDs). The center (also referred to as origin) of the light engine may include the placement of the negative temperature coefficient thermistor (NTC) R2.

It is noted that any number of light emitting diode (LED) 50 arrangements may be employed on the printed circuit board (PCB) 60 of the light engine 200. For example, the number of LEDs 50 may range from 5 LEDs to 70 LEDs. In another example, the number of LEDs 50 may range from 35 LEDs to 45 LEDs. It is noted that the above examples are provided for illustrative purposes only and are not intended to limit the present disclosure, as any number of LEDs 50 may be present the printed circuit board 60. In some other examples, the number of LEDs 50 may be equal to 5, 10, 15, 20, 25, 30, 35, 40, 45, 50, 55, 60, 65 and 70, as well as any range of LEDs 50 with one of the aforementioned examples as a lower limit to the range, and one of the aforementioned examples as an upper limit to the range. In some embodiments, chip on board (COB) light emitting diodes may be used in the light engine.

The LEDs 50 may be arranged as strings on the printed circuit board 60. When referring to a "string" of LEDs it is meant that each of the LEDs in the string are illuminated at the same time in response to an energizing act, such as the application of electricity from the driving electronics, e.g., driver, of the lamp including the light engine. The LEDs 50 in a string of LEDs are electrically connected for this purpose. For example, when a string of LEDs 50 is energized for illumination, all of the LEDs in the string are illuminated. Further, in some embodiments, illuminating the first string of LEDs 50 does not illuminate the LEDs in the second string of LEDs 50, and vice versa, as they are independently energized by the driving electronics, and not electrically connected. It is also noted that the same LED may be shared by more than one string.

In some embodiments, the LEDs 50 of the light engine are selected to be capable of being adjusted for the color of the light they emit. The term "color" denotes a phenomenon of light or visual perception that can enable one to differentiate objects. Color may describe an aspect of the appearance of objects and light sources in terms of hue, brightness, and saturation. Some examples of colors that may be suitable for use with the method of controlling lighting in accordance with the methods, structures and computer program products described herein can include red (R), orange (O), yellow (Y), green (G), blue (B), indigo (I), violet (V) and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein.

The LEDs 50 of the light engine 200 may also be selected to allow for adjusting the "color temperature" of the light they emit. The color temperature of a light source is the temperature of an ideal black-body radiator that radiates light of a color comparable to that of the light source. Color temperature is a characteristic of visible light that has applications in lighting, photography, videography, publishing, manufacturing, astrophysics, horticulture, and other fields. Color temperature is meaningful for light sources that do in fact correspond somewhat closely to the radiation of some black body, i.e., those on a line from reddish/orange via yellow and more or less white to blueish white. Color temperature is conventionally expressed in kelvins, using the symbol K, a unit of measure for absolute temperature. Color temperatures over 5000 K are called "cool colors" (bluish white), while lower color temperatures (2700-3000 K) are called "warm colors" (yellowish white through red). "Warm" in this context is an analogy to radiated heat flux of traditional incandescent lighting rather than temperature. The spectral peak of warm-colored light is closer to infrared, and most natural warm-colored light sources emit significant infrared radiation. The LEDs 50 of the lamps provided by the present disclosure in some embodiments can be adjusted from 2K to 5K.

The LEDs 50 of the light engine 200 may also be selected to be capable of adjusting the light intensity/dimming of the light they emit. In some examples, dimming or light intensity may be measured using lumen (LM). In some embodiments, the dimming or light intensity adjustment of the LEDs 50 can provide for adjusting lighting between 100 LM to 2000 LM. In another embodiment, dimming or light intensity adjustment of the LEDs 50 can provide for adjusting lighting between 500 LM to 1750 LM. In yet another embodiment, the dimming or light intensity adjustment of the LEDs 50 can provide for adjusting lighting between 700 LM to 1500 LM.

In some embodiments, the LED light engine 200 for the lamp may provide the that light emitting diodes (LEDs) be an SMD (Surface Mount Diode) LED and/or a COB (Chip on Board) LED. In some embodiments, the LEDs 50 may be selected to be SMD type emitters, in which the SMDs are more efficient than COBs because the light source produces higher lumens per watt, which means that they produce more light with a lower wattage. In some embodiments, the SMD type LEDs 50 can produce a wider beam of light which is spread over a greater area when compared to light engines of COB type LEDs. This means that less material is needed for the heat sink, which in turn means that they are more economical. It is noted that the above description of the light emitting diodes (LEDs) 50 is provided for illustrative purposes only, and is not intended to limit the present disclosure. For example, In some embodiments, other light sources may either be substituted for the LEDs 50, or used in combination with the LEDs 50, such as organic light-emitting diodes (OLEDs), a polymer light-emitting diode (PLED), and/or a combination of any one or more thereof.

Figure 6:
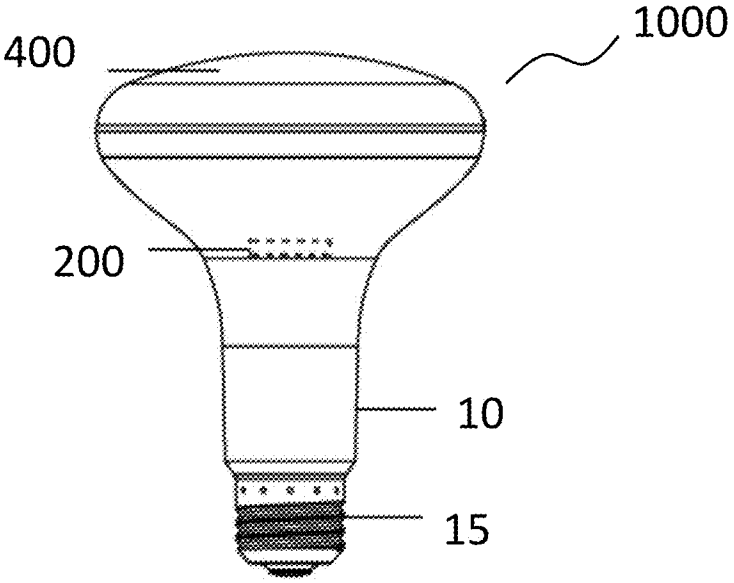
FIG. 6 is a side perspective view of the lamp depicted in FIG. 5.
Figure 5:
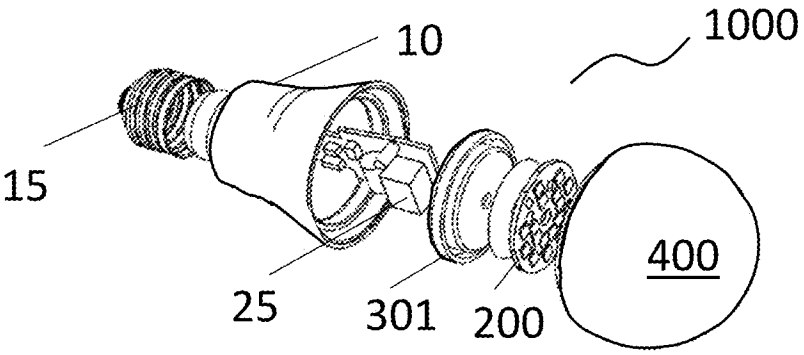
FIG. 5 is an exploded perspective view of a lamp including the hardware for temperature monitoring in a lamp including a light emitting diode (LED) light engine being integrated with the electronics package of a lamp, and for adjusting the lighting characteristics, such as lumen output and color in response to the temperature, in accordance with one embodiment of the present disclosure.

The positioning of the light engine 200 (depicted in FIG. 4) within the lighting device, e.g., lamp, is illustrated in FIGS. 5 and 6. The light engine 200 is positioned underlying the globe 400 of the lamp 1000, and can be present on a body portion 10 of the lamp contains the driver electronics 25. The body portion 10 may be composed of a polymeric material. The light engine 200 may be present at the light emission end of the body 10, and an electrode 15 may be present at the base of the body 10.

In some embodiments, the globe 400 is a hollow translucent component, houses the light engine 200 inside, and transmits the light from the light engine 200 to outside of the lamp 1000. In some embodiments, the globe 400 is a hollow glass bulb made of silica glass transparent to visible light. The globe 400 can have a shape with one end closed in a spherical shape, and the other end having an opening. In some embodiments, the shape of the globe 400 is that a part of hollow sphere is narrowed down while extending away from the center of the sphere, and the opening is formed at a part away from the center of the sphere. In the embodiment that is depicted in FIG. 5, the shape of the globe 400 is Type A (JIS C7710) which is the same as a common incandescent light bulb. It is noted that this geometry is provided for illustrative purposes only and is not intended to limit the present disclosure. For example, the shape of the globe 400 may also be Type G, Type BR, or others. The portion of the globe 400 opposite the opening may be referred to as the "dome portion of the optic".

Referring to FIG. 6, the lamp 1000 can optionally include a heatsink portion 301 configured to be in thermal communication with light engine 200 to facilitate heat dissipation for the lamp 1000. To that end, optional heatsink portion 301 may be of monolithic or polylithic construction and formed, in part or in whole, from any suitable thermally conductive material. For instance, optional heatsink portion 301 may be formed from any one, or combination, of aluminum (Al), copper (Cu), gold (Au), brass, steel, or a composite or polymer (e.g., ceramics, plastics, and so forth) doped with thermally conductive material(s). The geometry and dimensions of optional heatsink portion 301 may be customized, as desired for a given target application or end-use. In some instances, a thermal interfacing layer 301 (e.g., a thermally conductive tape or other medium) optionally may be disposed between heatsink portion 301 and light engine 200 to facilitate thermal communication there between. Other suitable configurations for optional heatsink portion 301 and optional thermal interfacing layer will depend on a given application.

It is noted that the structure and lamp systems of the present disclosure are not limited to only the form factor for the lamp 1000 that is depicted in FIGS. 5 and 6. As will be appreciated in light of this disclosure, the lamp as variously described herein may also be configured to have a form factor that is compatible with power sockets/enclosures typically used in existing luminaire structures. For example, some embodiments may be of a PAR20, PAR30, PAR38, or other parabolic aluminized reflector (PAR) configuration. Some embodiments may be of a BR30, BR40, or other bulged reflector (BR) configuration. Some embodiments may be of an A19, A21, or other A-line configuration. Some embodiments may be of a T5, T8, or other tube configuration.

The electrode 15 may be configured to be operatively coupled with a given power socket so that power may be delivered to lamp 1000 for operation thereof. To that end, the electrode 15 may be of any standard, custom, or proprietary contact type and fitting size, as desired for a given target application or end-use. In some cases, electrode 15 may be configured as a threaded lamp base including an electrical foot contact (e.g., an Edison-type screw base, such as in FIGS. 5 and 6). In some other cases, the electrode 15 may be configured as a bi-pin, tri-pin, or other multi-pin lamp base. In some other cases, the electrode 15 may be configured as a twist-lock mount lamp base. In some other cases, electrode 15 may be configured as a bayonet connector lamp base. Other suitable configurations for body portion 10 and electrode 15 will depend on a given application and will be apparent in light of this disclosure.

Figure 7:
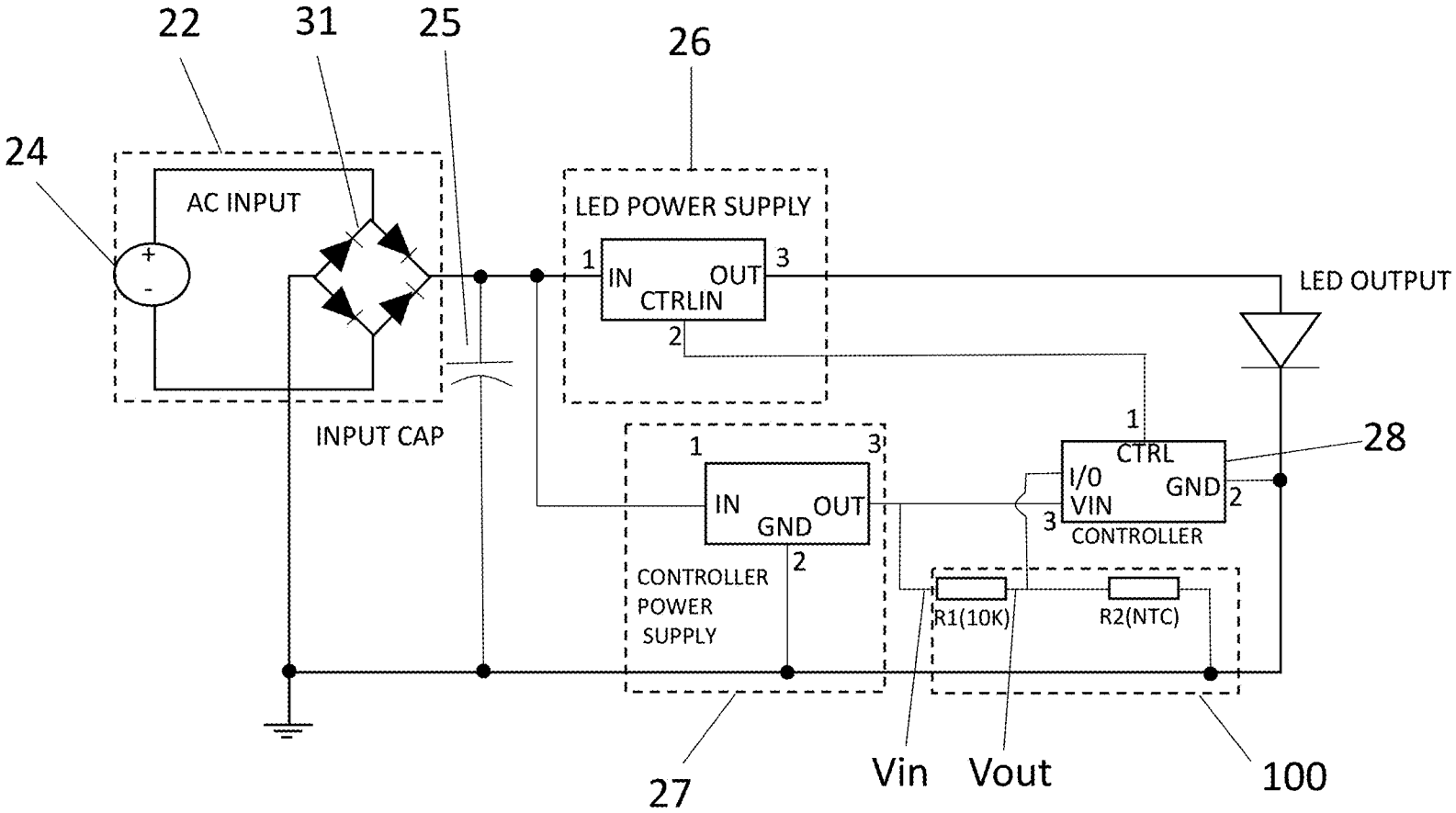
FIG. 7 is a circuit diagram for the hardware for temperature monitoring in a lamp including a light emitting diode (LED) light engine being integrated with the electronics package of a lamp, in accordance with one embodiment of the present disclosure.
Figure 8:
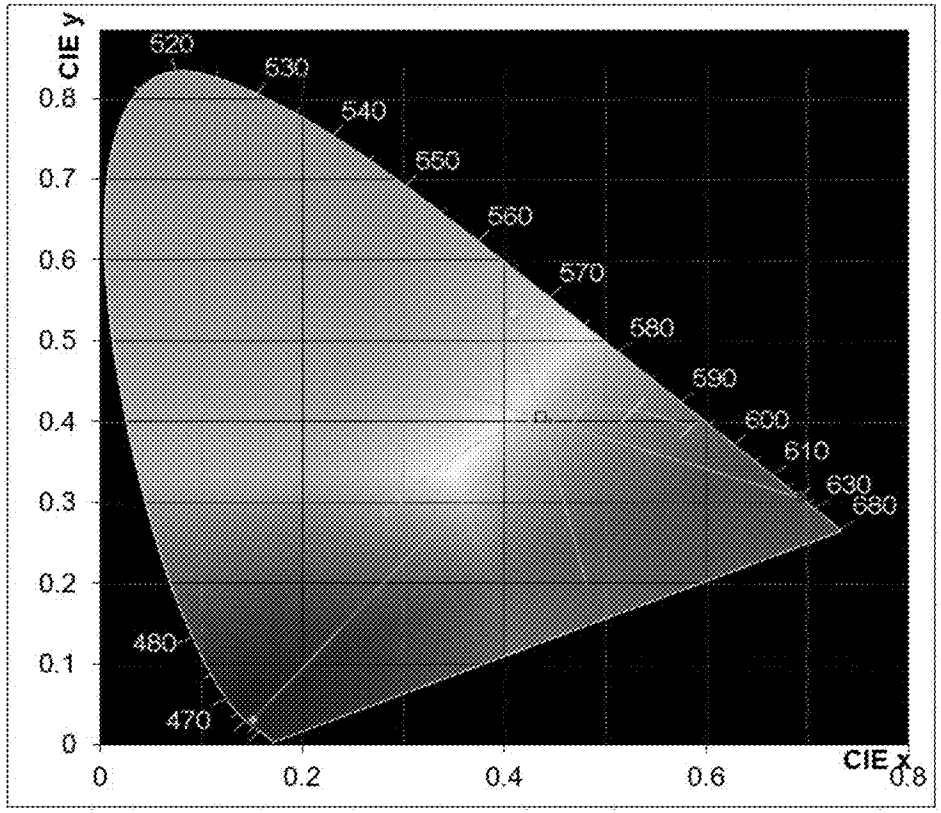
FIG. 8 illustrates one embodiment of a CIE 1931 color space chromaticity diagram.

The driver electronics 25 may be present in the body portion 10 of the lighting device, e.g., lamp 1000. FIG. 7 illustrates one embodiment for the circuit diagram for the driver electronics 25 for the lighting device 1000, e.g., lamp. FIG. 7 illustrates one embodiment of a circuit diagram for the hardware for temperature monitoring in a lamp including a light emitting diode (LED) light engine 200 being integrated with the electronics package of a lamp. The electronics package of the lamp may include an AC input source 24, an input capacitor 25, a light emitting diode (LED) power supply 26, a control power supply 27, a microcontroller 28 and the thermistor sensing setup, or thermistor sensor 100. The thermistor sensing setup, or thermistor sensor 100, is connected to the light source, i.e., output LED 29. The output LED 29 that is depicted in FIG. 7 can be provided by the light engine 200 depicted in FIG. 4.

In some embodiments, the AC input source 24 includes a bridge rectifier 31. In some embodiments, the bridge rectifier 31 is a diode bridge rectifier connected to the AC power input 24. Diodes for the diode bridge rectifier 31 can be connected together to form a full wave rectifier that convert AC voltage into DC voltage for use in power supplies. The diode bridge rectifier 31 may include four diodes that are arranged in series pairs with only two diodes conducting current during each half cycle.

The input capacitor 25 may also be referred to as a smoothing capacitor, and can provide for stabilizing the input voltage. A "capacitor" is a passive two-terminal electronic component that stores electrical energy in an electric field. In some embodiments, inside the capacitor, the terminals connect to two metal plates separated by a non-conducting substance, or dielectric.

As used herein, the term "smart bulb" or "smart LED bulb" denotes a lighting device, such as a light bulb or lamp, having a controller 28, e.g., microcontroller, as one of the components of the device, in which the controller 28 effectuates at least one set of instructions for controlling at least one characteristic of light being emitted from the device.

In the smart lamps of the present disclosure, the controller 28, e.g., microcontroller, can be used to control functions of the lamp, such as lighting characteristics, e.g., light color, light intensity, light temperature, light dimming, light flickering and combinations thereof in response to temperature changes. The temperature changes can be measured from the thermistor sensing setup, or thermistor sensor 100. The controller 28 taking account the temperature changes being experienced by the light engine 200 adjusts the lighting characteristics to provide accurate luminous flux and color under different temperature conditions by employing a temperature feedback loop.

In some embodiments, the controller 28 may be a microcontroller. A microcontroller may be an integrated circuit (IC) designed to govern a specific operation in an embedded system. In some embodiments, the microcontroller includes a processor, memory and input/output (I/O) peripherals on a single chip. The microcontroller may sometimes be referred to as an embedded controller or microcontroller unit (MCU).

The controller 28 can be substituted with any type of controller that can control the LED power supply 26. For example, the controller 28 may include memory and one or more processors, which may be integrated into a microcontroller. The memory can be of any suitable type (e.g., RAM and/or ROM, or other suitable memory) and size, and in some cases may be implemented with volatile memory, non-volatile memory, or a combination thereof. A given processor of the controller 28 may be configured, for example, to perform operations associated with the light engine 200 (as depicted in FIG. 4) through the LED output circuit 29. For example, the controller 28 may include a processor configured to take into account the temperature changes being experienced by the light engine 200, and to adjust the lighting characteristics to provide accurate luminous flux and color under different temperature conditions. The controller 28 may be configured to employ a temperature feedback loop.

In some cases, memory may be configured to programs, applications, store media and/or content on the controller 28, e.g., microcontroller, on a temporary or permanent basis. For example, the memory may be configured to store directions for adjusting lighting parameters in response to temperature changes being experienced by the light engine 200, in which the lighting characteristics are adjusted to provide accurate luminous flux and color under different temperature conditions. The adjustments may employ a temperature feedback loop. The one or more modules stored in memory can be accessed and executed, for example, by the one or more processors of the controller 28, e.g., microcontroller.

The microcontroller can also be used to turn the lamps ON and OFF in response to time, and calendar date. The microcontroller can also be used to change lighting characteristics in response to commands received wirelessly, e.g., from a user interface of a desktop computer and/or a wireless device, such as a tablet, smartphone or similar type device. The microcontroller can also change lighting characteristics in response to signal received from a sensor, such as a light sensor, motion sensor or other like sensor.

The circuit depicted in FIG. 7 also includes an LED power supply circuit 26, and a controller power supply circuit 27. The controller power supply circuit 27 may include a voltage regulator. The input of the controller power supply circuit 27 is from a rectifying bridge 31 of an AC input circuit 22. The output of the controller power supply circuit 27 is to the controller circuit that includes the controller 28, e.g., the microcontroller, in which power is communicated from the power supply circuit 27 to the controller circuit 28 for the purposes of powering the controller 28, e.g., microcontroller. The controller circuit 28, which can include a microcontroller, has a control output to an LED power supply circuit 26. The LED power supply circuit 26 may have an output in electrical communication with the output LED circuit 29, which is in communication with the light engine 200. In this example, the controller 28, e.g., microcontroller, can provide signals for controlling the LED power supply circuit 26. The controller 28, e.g., microcontroller, can provide signals for controlling the LED power supply circuit 26 to adjust the power being supplied to the output LED circuit 29, in which the adjustment to the power to the output LED circuit 29 is in accordance with the lighting characteristics being controlled by the controller 28, e.g., microcontroller.

The thermistor sensing setup, or thermistor sensor 100, is in electrical communication with the controller, e.g., microcontroller. The thermistor sensing setup, or thermistor sensor 100, includes a fixed resistor R1 and a negative temperature coefficient resistor (NTC). The NTC is directly mounted onto a metal core printed circuit board (PCB) 60 of the light engine 200 (depicted in FIG. 4), which also houses the LEDs. In some embodiments, a fixed voltage, e.g., 3.3 V, is introduced in Vin. In some embodiments, the fixed voltage is provided by the controller power supply 27, e.g., provided from OUT of the controller power supply 27. The voltage out (Vout) from the thermistor sensing setup, or thermistor sensor 100, will be monitored by the system. In some embodiments, the voltage out (Vout) from the thermistor sensing setup, or thermistor sensor 100, is connected to the input/output (I/O VIN) of the controller 28, e.g., microcontroller. The resistance of the NTC is a good indicator of the PCB temperature and LED temperatures. With proper calibration, one can derive the LEDs temperatures by monitoring the Vout.

The controller 28, e.g., microcontroller, may be programmed, e.g., calibrated, so that the temperatures that are measured using the thermistor sensing setup, or thermistor sensor 100, can be employed as a thermal feedback system in combination with color calibration based on a user's input to solve color accuracy problems. In some embodiments, an algorithm, as illustrated in equations 1 through 4, take into account the system temperature and the users' input for controlling lighting characteristics to provide that the output color and lumens are correct regardless of the operation condition.

The method of operation can begin with a user selecting a color and/or color correlated temperature and/or brightness characteristic of light to be projected by the light engine 200 of the lamp. Generally, the range of different colors, different color correlated temperatures and brightness for the light being emitted by the lamp can be limited by the selection for the type and number of light emitting diodes in the light engine 200. However, for a grouping of light emitting diodes there is a range of possible different colors, and/or differed color correlated temperature (CCTs), and/or different intensities. The lighting methods of the present disclosure can begin with selecting the characteristics of illumination that are desired by the lamp. In some embodiments, the characteristics of light being projected by the light engine 200 may be set at the factory and fixed. In other embodiments, there is an interface with the lamp 1000 allows for the user to adjust the lighting characteristics of the light being projected by the lamp 1000. These adjustments can be changed by the consumer through the interface. The lamp 1000 may include a communications module 245 for communication with the interface through which the user is setting the lighting characteristics.

Figure 9:
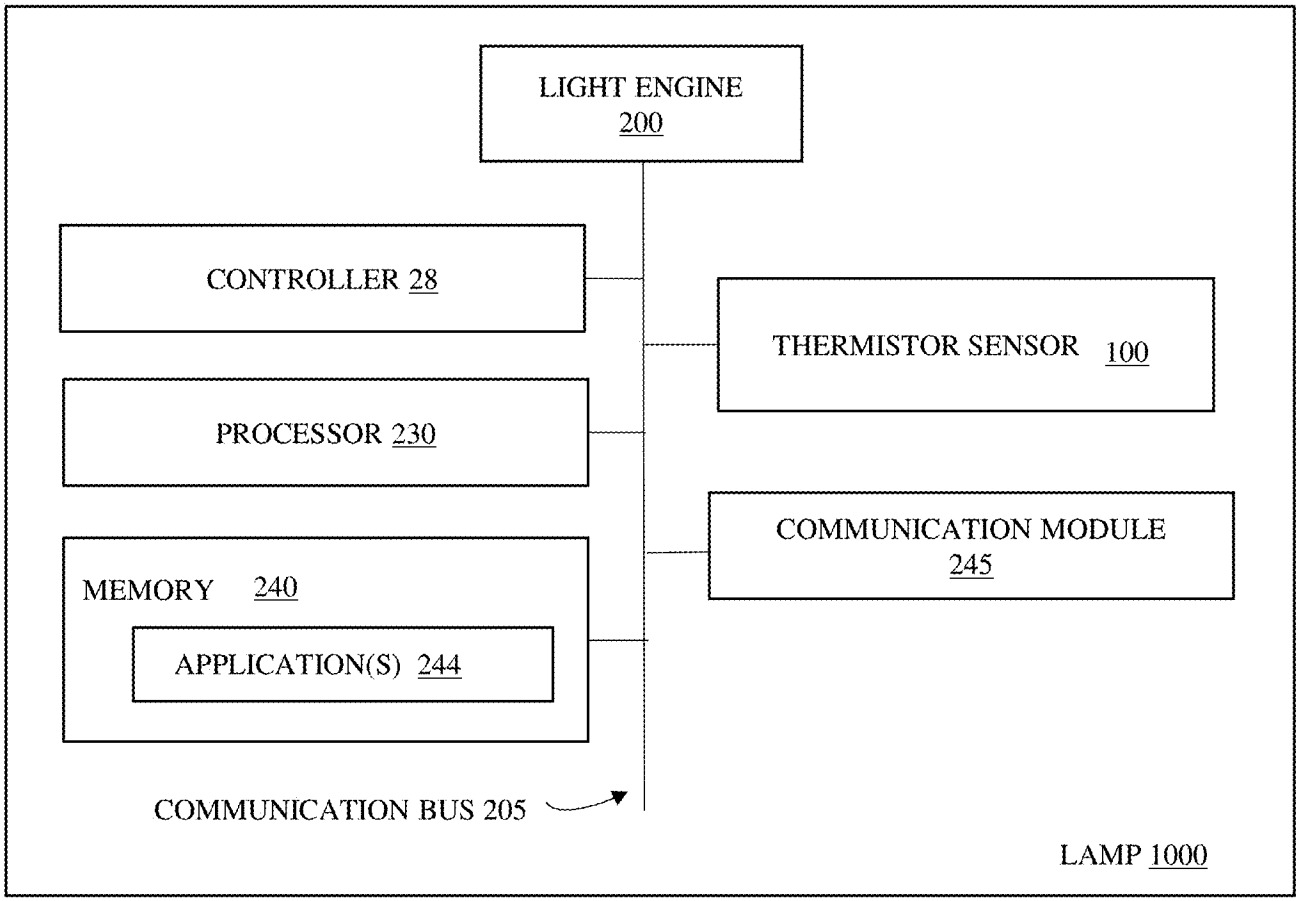
FIG. 9 is an illustration (block diagram) of an exemplary lamp system that can work in communication with the mobile device system for controlling lighting, in accordance with one embodiment of the present disclosure.

FIG. 9 is a block diagram of an exemplary lamp 1000 including a communication module 245 that can work in communication with the mobile device system for setting lighting characteristics of the lamp. As can be seen, lamp 1000 may include one or more light engines 200 that provides a corresponding light output having the selected lighting characteristics. As noted above, the light engine 200 of the lamp 1000 may include one may include one or more thermistor sensing setup, or thermistor sensor 100. The thermistor sensor 100 may include a fixed resistor R1 and a negative temperature coefficient thermistor (NTC) R2, as discussed above with reference to FIGS. 2 and 7. In some embodiments, the thermistor sensor 100 may be integrated with other sensors, such as thermometers and/or light sensors.

The lamp 1000 may include at least one controller 28, at least one processor 230, and/or memory 240. Controller(s) 28 may be configured to be operatively coupled (e.g., via a communication bus or other suitable interconnect) with light engine 200 or corresponding componentry, such as the light source drivers (not shown), to control the light output provided therefrom. The controller 28 may work in combination with the processor 230 to control the light characteristics of the lamp 1000.

The controller 28 is in communication with the communication bus 205, hence receives signals from the mobile computing device through the communications module 245. In some embodiments, a given lamp 1000 may include a communication module 245, which may be configured for wired (e.g., Universal Serial Bus or USB, Ethernet, FireWire, etc.) and/or wireless (e.g., Wi-Fi, Bluetooth, etc.) communication, as desired. In accordance with some embodiments, the communication module 245 may be configured to communicate locally and/or remotely utilizing any of a wide range of wired and/or wireless communications protocols, including, for example: (1) a digital multiplexer (DMX) interface protocol; (2) a Wi-Fi protocol; (3) a Bluetooth protocol; (4) a digital addressable lighting interface (DALI) protocol; (5) a ZigBee protocol; and/or (6) a combination of any one or more thereof. It should be noted, however, that the present disclosure is not so limited to only these example communications protocols, as in a more general sense, and in accordance with some embodiments, any suitable communications protocol, wired and/or wireless, standard and/or custom/proprietary, may be utilized by communication module 245, as desired for a given target application or end-use. In some instances, the communication module 245 may be configured to facilitate inter-system communication between the lamp 1000 and the mobile computing device 500.

The signals received from the mobile computing device 500 can include information on selected light characteristics, which can include light color, light intensity/dimming and light color temperature, that was selected by the user for the type of light to be projected by the lamp 1000. The controller 28 can control the light output of the light engine 200 to meet the requirements of the selected light characteristics, in which the lighting characteristics can be selected through an interface provided by the mobile computing device 500. The controller 28 can control the light output by adjusting current, e.g., pulse width modulation (PWM) values, to the light engine 200. In some embodiments, when the light engine 200 includes multiple strings of light emitting diodes, the controller 28 can individually adjust the current, e.g., pulse width modulation (PWM) values, to each of the strings of light emitting diodes.

The adjustments can be in response to changes in temperature sensed with the thermistor sensor 100. The user selects light characteristics, e.g., color characteristics, which are converted into the X, Y, Z scale of the International Commission (CIE) 1931 XYZ color space. The light that is emitted by the light emitting diodes (LED) of the light engine 200 changes in characteristics with change in temperature. More specifically, the light characteristics emitting by a light engine of light emitting diodes for matching the X, Y, Z scale on the International Commission (CIE) 1931 XYZ color space responsive to a first electrical condition, e.g., current to energize the LEDs, at one temperature will generally not provide light responsive to the same electrical condition having the same X, Y, Z scale on the on the International Commission (CIE) 1931 XYZ color space when the temperature changes to a second temperature, i.e., a temperature having a higher or lower value than the first temperature. However, in accordance with the methods and systems of the present disclosure, the controller 28 receiving data that the operation temperature of the LED has changed, can also change the electrical conditions, e.g., current, such as pulse width modulation (PWM) value, that is applied to the light engine 200 to energize the light emitting diodes (LEDs) in a manner that provides light having the same X, Y, Z scale on the on the International Commission (CIE) 1931 XYZ color space at the operation temperature. Applications 244 are stored on the memory 240 correlating resistance measurements by the thermistor sensing setup, also referred to as thermistor sensor 100, to changes in operation temperature. Further, a plurality of temperature and lighting conditions correlating lighting characteristics on the X, Y, Z scale of the International Commission (CIE) 1931 XYZ color space for the selected light emitting diodes (LEDs) of the light engine 200 to the electrical conditions for energizing the light emitting diodes (LEDs) at the different temperatures to provide light having lighting characteristics on the X, Y, Z scale of the International Commission (CIE) 1931 XYZ color space are also stored on the memory 240 of the lamp 1000. Applications 244 stored on the memory 240 executed by the controller 28, which can include the processor 230, allow the controller 28 to adjust the electrical conditions that energize the light emitting diodes for providing the user selected lighting characteristics on the X, Y, Z scale of the International Commission (CIE) 1931 XYZ color space at the operating temperature of the light engine 200. The applications 244 continually update the electrical conditions used to energize the light emitting diodes (LEDs) of the light engine 200 over time to accommodate changes in operating temperature.

Still referring to FIG. 9, the memory 240 used by the lamp 1000 can be of any suitable type (e.g., RAM and/or ROM, or other suitable memory) and size, and in some cases may be implemented with volatile memory, non-volatile memory, or a combination thereof. A given processor 230 may be configured as typically done, and in some embodiments may be configured, for example, to perform operations associated with the lamp 1000 and one or more of the modules thereof (e.g., within memory 240 or elsewhere). In some cases, memory 240 may be configured to be utilized, for example, for processor workspace (e.g., for one or more processors 230) and/or to store media, programs, applications 244, and/or content for lamp 1000 or system on a temporary or permanent basis.

The one or more modules stored in memory 240 can be accessed and executed, for example, by the one or more processors 230 of the lamp 1000. In accordance with some embodiments, a given module of memory 240 can be implemented in any suitable standard and/or custom/proprietary programming language, such as, for example: (1) C; (2) C++; (3) objective C; (4) JavaScript; and/or (5) any other suitable custom or proprietary instruction sets, as will be apparent in light of this disclosure. The modules of memory 240 can be encoded, for example, on a machine-readable medium that, when executed by a processor 230, carries out the functionality of lamp 1000 or system, in part or in whole. The computer-readable medium may be, for example, a hard drive, a compact disk, a memory stick, a server, or any suitable non-transitory computer/computing device memory that includes executable instructions, or a plurality or combination of such memories. Other embodiments can be implemented, for instance, with gate-level logic or an application-specific integrated circuit (ASIC) or chip set or other such purpose-built logic. Some embodiments can be implemented with a microcontroller having input/output capability (e.g., inputs for receiving user inputs; outputs for directing other components) and a number of embedded routines for carrying out the device functionality. In a more general sense, the functional modules of memory 240 (e.g., one or more applications 244, discussed below) can be implemented in hardware, software, and/or firmware, as desired for a given target application or end-use. In some embodiments, the memory may include an operating system (OS). As will be appreciated in light of this disclosure, the OS may be configured to control the characteristics of light being emitted by the light engine 200 through the LED output circuit 29. More specifically, the applications 244 adjust current, e.g., pulse width modulation values, to the light engine 200 in response to temperature changes to adjust light to meet the lighting characteristics selected by the user, which are correlated to the X, Y, Z scale of the International Commission (CIE) 1931 XYZ color space.

Figure 10:
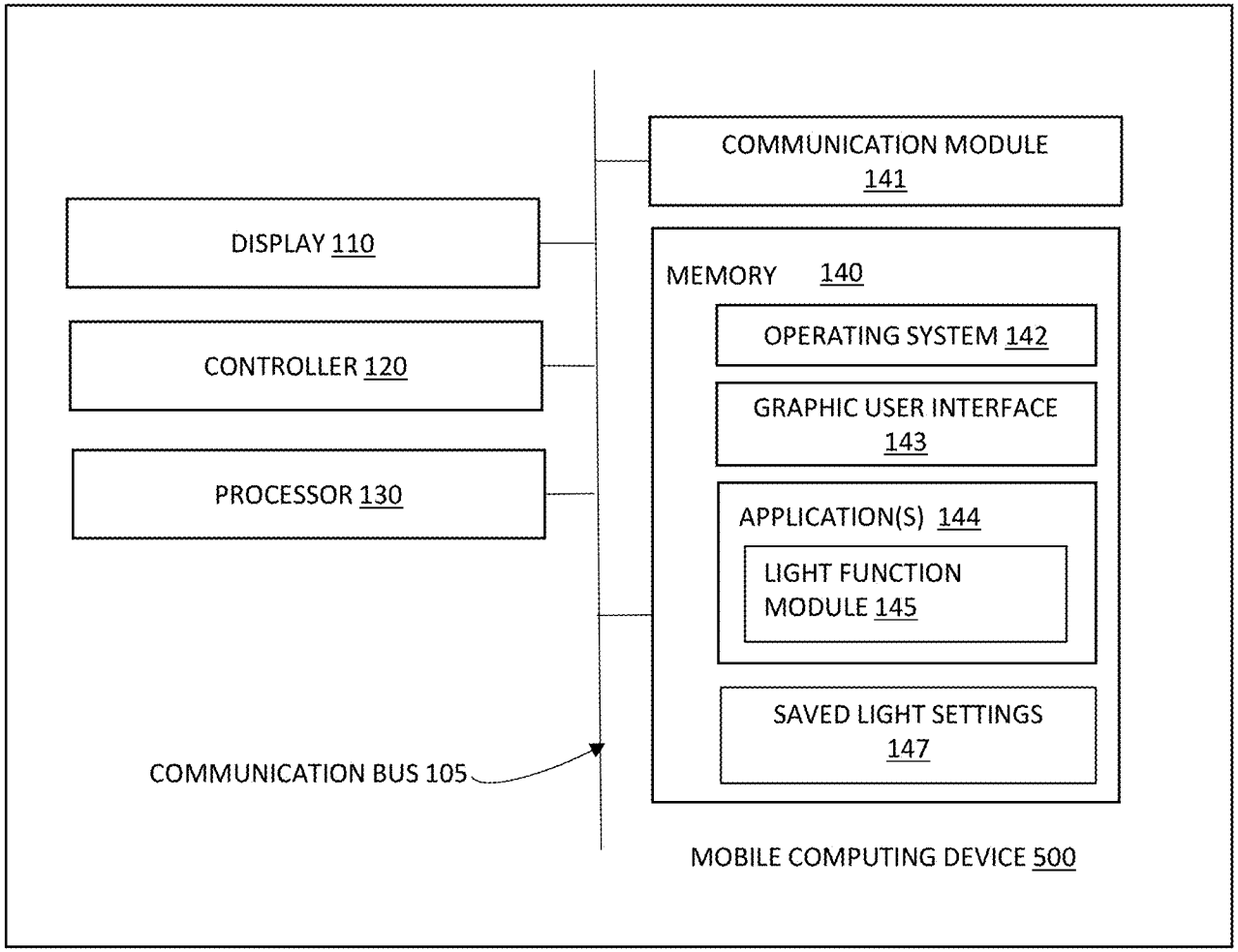
FIG. 10 is an illustration (block diagram) an exemplary mobile device system for controlling lighting using a mobile computing device having a motion sensor that is present therein, in accordance with an embodiment of the present disclosure.

In some embodiments, the user can select the characteristics of light they wish to be projected by the lamp using a mobile device 500. FIG. 10 is a block diagram of one embodiment of a mobile device system 500 for the lamps 1000 described herein that modify the current, e.g., pulse width modulation (PWM) values, for energizing the light emitting diodes of the light engine to compensate for changes in operating temperature while providing the light characteristics selected by the user according to the X, Y, Z scale of the International Commission (CIE) 1931 XYZ color space. The mobile computing device 500 can be any of a wide range of computing platforms. In some embodiments, the mobile computing device 500 carr be a laptop/notebook computer or sub-notebook computer; a tablet or phablet computer; a mobile phone or smartphone; a personal digital assistant (PDA), a portable media player (PMP); a cellular handset; a handheld gaming device; a gaming platform; a wearable or otherwise body-borne computing device, such as a smartwatch, smart glasses, or smart headgear; and/or a combination of any one or more thereof.

The mobile computing device 500 may include a display 110. The display 110 can be any electronic visual display or other device configured to display or otherwise generate an image (e.g., image, video, text, and/or other displayable content) therefrom. In some embodiments, the display 110 is a touchscreen display or other touch-sensitive display that can utilize any of a wide range of touch-sensing techniques, such as, for example: resistive touch-sensing; capacitive touch-sensing; surface acoustic wave (SAW) touch-sensing; infrared (IR) touch-sensing; optical imaging touch-sensing; and/or a combination of any one or more thereof. The touch screen display 110 may be configured to detect or otherwise sense direct and/or proximate contact from a user's finger, stylus, or other suitable implement (which can be collectively referred to as a touch gesture) at a given location of that display 110. The touch screen display 110 may be configured to translate such contact into an electronic signal that can be processed by mobile computing device 500 (e.g., by the one or more processors 130 thereof) and manipulated or otherwise used to trigger a given GUI action. In some cases, a touch-sensitive display 110 may facilitate user interaction with the mobile computing device 500 via the graphic user interface presented by such display 110.

In accordance with some embodiments, the computing device 500 may include or otherwise be communicatively coupled with one or more controllers 120, as depicted in FIG. 10. A given controller 120 may be configured to output one or more control signals to control any one or more of the various components/modules of computing device 500 and may do so, for example, based on wired and/or wireless input received from a given local source (e.g., such as on-board memory 140) and/or remote source (e.g., such as a control interface, optional server/network 400, etc.). In accordance with some embodiments, a given controller 120 may host one or more control modules and can be programmed or otherwise configured to output one or more control signals, for example, to adjust the operation of a given portion of computing device 500. For example, in some cases, a given controller 120 may be configured to output a control signal to the luminaire 1000 in selecting lighting characteristics.

The mobile computing device 500 may include memory 140 and one or more processors 130. Memory 140 can be of any suitable type (e.g., RAM and/or ROM, or other suitable memory) and size, and in some cases may be implemented with volatile memory, non-volatile memory, or a combination thereof. A given processor 130 of computing device 500 may be configured as typically done, and in some embodiments may be configured, for example, to perform operations associated with computing device 500 and one or more of the modules thereof (e.g., within memory 140 or elsewhere). In some cases, memory 140 may be configured to be utilized, for example, for processor workspace (e.g., for one or more processors 130) and/or to store media, programs, applications, and/or content on computing device 500 on a temporary or permanent basis.

The one or more modules stored in memory 140 can be accessed and executed, for example, by the one or more processors 130 of computing device 500. In accordance with some embodiments, a given module of memory 140 can be implemented in any suitable standard and/or custom/proprietary programming language, such as, for example C, C++, objective C, JavaScript, and/or any other suitable custom or proprietary instruction sets, as will be apparent in light of this disclosure. The modules of memory 140 can be encoded, for example, on a machine-readable medium that, when executed by one or more processors 130, carries out the functionality of computing device 500, in part or in whole. The computer-readable medium may be, for example, a hard drive, a compact disk, a memory stick, a server, or any suitable non-transitory computer/computing device memory that includes executable instructions, or a plurality or combination of such memories. Other embodiments can be implemented, for instance, with gate-level logic or an application-specific integrated circuit (ASIC) or chip set or other such purpose-built logic. Some embodiments can be implemented with a microcontroller having input/output capability (e.g., inputs for receiving user inputs; outputs for directing other components) and a number of embedded routines for carrying out the device functionality. In a more general sense, the functional modules of memory 140 (e.g., such as operating system (OS) 142, graphic user interface (GUI) 143, and/or one or more applications 144, each discussed below) can be implemented in hardware, software, and/or firmware, as desired for a given target application or end-use. The memory 140 may include an operating system (OS) 142. The OS 142 can be implemented with any suitable OS, mobile or otherwise, such as, for example, Android OS from Google, Inc.; iOS from Apple, Inc.; BlackBerry OS from BlackBerry Ltd.; Windows Phone OS from Microsoft Corp: Palm OS/Garnet OS from Palm, Inc.; an open source OS, such as Symbian OS; and/or a combination of any one or more thereof.

As will be appreciated in light of this disclosure, OS 142 may be configured, for example, to aid with the lighting controls for adjusting the electrical signal for energizing the light emitting diodes of the light engine responsive to the operating temperature of the light engine 200 to provide light characteristics to be projected by lamp 1000 selected by the user.

The memory 140 may also include at least one module for saved light settings 147. The saved light settings 147 include the lighting parameters that a user may have saved for a light function form, e.g., lamp type, or scene, e.g., room type. The saved light settings 147 can include colors for the light characteristics to be projected by the light engine 200.

In accordance with some embodiments, mobile computing device 500 may include a graphic user interface (GUI) module 143. In some cases, GUI 143 can be implemented in memory 140. GUI 143 may be configured, in accordance with some embodiments, to present a graphical UI (GUI) at display 110 that is configured, for example, to aid in the selection of lighting characteristics. For example, the GUI 143 may include an interface with a color wheel. The user may select from the color wheel the color characteristics for the light to be projected by the lamp 1000. In some examples, the color that is selected from the color wheel is converted to values on the X, Y, Z scale of the International Commission (CIE) 1931 XYZ color space. A signal indicating these values is then sent from the mobile computing device 500 to the lamp 1000.

The memory 140 may have stored therein (or otherwise have access to) one or more applications 144. In some instances, mobile computing device 500 may be configured to receive input, for example, via one or more applications 144 stored in memory 140, such as a light function module 145. The light function module 145 provides a plurality of selectable light function settings, e.g., light color settings, on the graphic user interface 143. For example, the it function module 145 may provide a color wheel **10*a* for selecting colors to be projected by the light engine 200. Further details for the color wheel 10*a* are provided in the description of FIG. 11**.

The mobile device 500 further includes include a communication module 141. The communication module 141 can be configured to transmit a signal to the lamp 1000 providing instruction that the lamp 1000 display a selected light function setting, e.g., color. The selected it function setting, e.g., color, being selected by the user from via graphic user interface (GUI) module 143, e.g., color wheel **10*a*. The communication module 141 may be configured for wired (e.g., Universal Serial Bus or USB, Ethernet, FireWire, etc.) and/or wireless (e.g., Wi-Fi, Bluetooth, etc.) communication using any suitable wired and/or wireless transmission technologies radio frequency, or RE, transmission; infrared, or IR, light modulation; etc.), as desired. In some embodiments, the communication module 141 may be configured for communication by cellular signal used in cellular phones, and cellular type devices. In some embodiments, communication module 141 may be configured to communicate locally and/or remotely utilizing any of a wide range of wired and/or wireless communications protocols, including, for example: (1) a digital multiplexer (DMX) interface protocol; (2) a Wi-Fi protocol; (3) a Bluetooth protocol; (4) a digital addressable lighting interface (DALT) protocol; (5) a ZigBee protocol; (6) a near field communication (NEC) protocol; (7) a local area network (LAN)-based communication protocol; (8) a cellular-based communication protocol; (9) an Internet-based communication protocol; (10) a satellite-based communication protocol; and/or (11) a combination of any one or more thereof. It should be noted, however, that the present disclosure is not so limited to only these example communications protocols, as in a more general sense, and in accordance with some embodiments, any suitable communications protocol, wired and/or wireless, standard and/or custom/proprietary, may be utilized by communication module 141, as desired for a given target application or end-use. In some instances, communication module 141 may be configured to communicate with one or more lamps 1000. In some cases, communication module 141 of computing device 500 and communication module 245 of a given lamp 1000 (as described in FIG. 9**) may be configured to utilize the same communication protocol.

Figure 11:
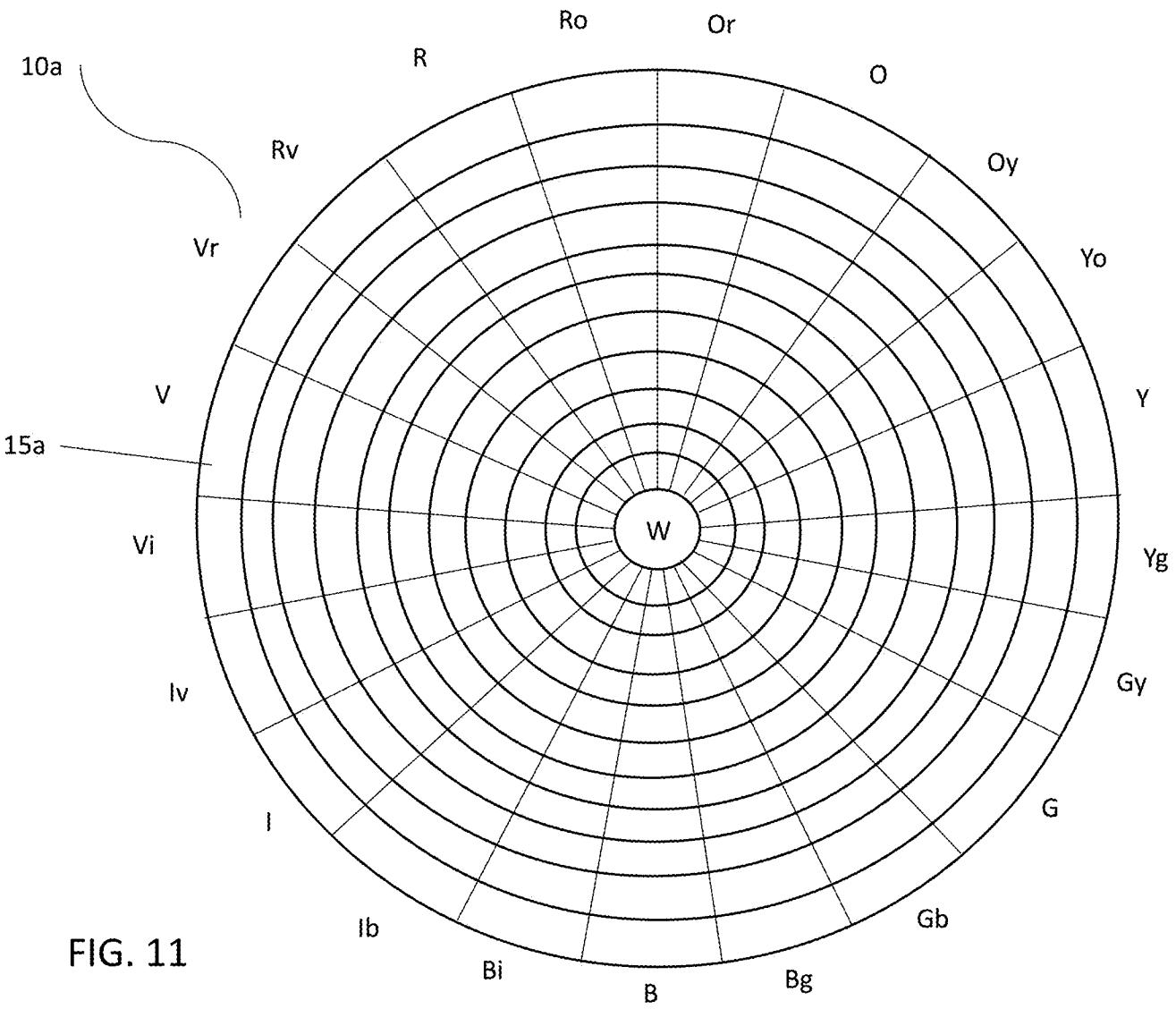
FIG. 11 is an illustration of a color wheel for use as a grid of selectable light characterization settings on the graphic user interface of the mobile device, in accordance with one embodiment of the present disclosure.

FIG. 11 is an illustration of a color wheel 10*a* for use as a grid of selectable light function settings 15*a* on the graphic user interface of the mobile device. The selectable light function settings may be colors to be projected by the light engine 200 of the lamp 1000. This can provide the interface by which the user can select the characteristic of light that the user wishes to be projected by the lamp 1000. In this example, the lamp 1000 includes applications 244 and hardware, e.g., thermistor sensor 100, that modify the current, e.g., pulse width modulation (PWM) value, applied to the light engine 200 to compensate for changes in temperature experienced by the light engine 200 (light emitting diodes of the light engine) to ensure that regardless of the operating temperature being experienced by the light engine 200 the light projected by the lamp 1000 meets the expectations of the user for the selected lighting characteristic, e.g., selected color.

In one embodiment, the grid of light functions that provides the selectable light function settings 15*a* for colors is in the form of a color wheel, as depicted in FIG. 11. In the example of the color wheel may include colors, such as red (R=red), orange (O=orange), green (G=green), blue (B=blue), indigo (I=indigo), and violet (V=violet), in which the color families are arranged following a perimeter in the ROYGBIV sequence. The color wheel 10*a* includes a plurality of selectable light function settings 15*a* for each family of the aforementioned colors. In some embodiments, the range of lightness to darkness for each family of colors may range from the lightest colors, i.e., having a greatest degree of white, starting from the center of the color wheel (at which white (W=white) is present), in an increasing degree of darkness, i.e., having a greater degree of black, to a darkest color at the perimeter of the color wheel 10*a*. In the example that is depicted in FIG. 11, there are 11 selectable light function settings 15*a* ranging from the lightest variation, i.e., closest to the center of the wheel, to the darkest variation of the color, i.e., present at the outermost perimeter of the wheel. It is noted that this is only one example of the degree of lightness/darkness, e.g., white/dark, present in a color, and is not intended to limit the present disclosure. In other embodiments, the amount of selectable light function settings 15*a* illustrating the range of lightness to darkness may be equal to 1, 5, 10, 15, 20, 30, 40, 50, 60, 80, 90, 100 and 1000, and any range of light function settings, in which one of the aforementioned examples provides a lower limit to the range and one of the aforementioned examples provides an upper limit to the range, as well as any value within those ranges.

Still referring to FIG. 11, the color wheel 10*a* may also provide for variations in the color family so that mixtures of colors, e.g., mixtures of red and orange, mixtures of orange and yellow, mixtures of yellow and green etc., are included within the selectable light function settings 15*a* of the color wheel. In the embodiment depicted in FIG. 11, each family of colors, i.e., red R, orange O, yellow Y, blue B, indigo I and violet V, may include members having a lesser amount of at least a second color that is mixed with the primary color, i.e., red R, orange O, yellow Y, blue B, indigo I and violet V, to provide different shades of the primary color. In the illustration of the color wheel 10*a* depicted in FIG. 11, for each of the selectable light function settings 15*a* the primary color is denoted with a capital letter illustrating the majority color, and a lower case letter, i.e., r=red, o=orange, y=yellow, b=blue, i=indigo and v=violet, to illustrate the minority color in the mixture. For example, Ro illustrates a color mixture in which red R is the primary color present in a majority that is mixed with orange o, in which orange o is the secondary color present in a minority amount. In the example depicted in FIG. 11, each color family includes two shades mixed with an adjacent color family on the color wheel. It is noted that this is only one example of the degree of the amount of color mixtures that can be in a family of a primary color, and is not intended to limit the present disclosure. In other embodiments, the amount of selectable light function settings 15*a* illustrating the range of shades/mixtures within a primary color may be equal to 1, 5, 10, 15, 20, 30, 40, 50 and 100, and any range of light function settings in which one of the aforementioned examples provides a lower limit to the range and one of the aforementioned examples provides an upper limit to the range, as well as any value within those ranges.

It is also noted that the circular geometry of the color wheel 10*a* that is depicted in FIG. 11 provides only one example of a geometry that is suitable for a grid of light functions including selectable light function settings 15*a* for color. In other embodiments, a square or other multi-sided geometry may be substituted for the color wheel. Additionally, the selectable light function settings 15*a* for color may be arranged in a bar scale type geometry. Hereafter, the color wheel may be referred to with reference number 10*a*. The colors, i.e., selectable light function settings 15*a*, may be selected from the color wheel 10*a* by touch screen interface.

As noted, the user selects a lighting characteristic to be projected by the lamp 1000. For example, the user can select a color from the color wheel 10*a*, as depicted in FIG. 11. The color selected by the user can be transmitted from the communication module 145 of the mobile device 500 for receipt at the communication module 245 of the lamp 1000. At some point, e.g., at the mobile device 500 and/or at the lamp 1000 the selected color is converted to values on the X, Y, Z scale of the International Commission (CIE) 1931 XYZ color space.

The lamp 1000 includes an application 244 for monitoring temperature of the light engine 200 during operation, and adjusting the current, e.g., pulse width modulation (PWM) values, to the light engine 200 to compensate for changes in operation temperature, so that despite operational temperature changes the light projected by the lamp 1000 meets the lighting characteristics selected by the user, e.g., color characteristics. In some embodiments, the application 244 that adjusts the lighting characteristics to meet the color requirements picked by the user according to the X, Y, Z scale of the International Commission (CIE) 1931 XYZ color space employs equations that calculate pulse width modulation (PWM) values as a function of temperature (T) for each type of light emitting diode (LED) in the lighting engine 200.

The method of correlating temperature to light output characteristics can begin with considering/selecting the different types of light emitting diodes (LEDs) for the light engine 200. For example, the light engine 200 may include a red colored LED type having a package size of 2622 O and a max current per color of approximately 510 mA, a lime colored LED type having a package size of 3030 and a max current per color of approximately 410 mA, a blue colored LED type having a package size of 3030 and a max current per color of approximately 200 mA, and a green colored LED type having a package size of 2835 and a max current of approximately 340 mA. Once the LEDs of the light engine 200 are characterized, a nominal current is run through each grouping of LED types and a light spectrum being illuminated from the LED type is collected, i.e., illuminated.

For example, starting with the red type light emitting diodes (LEDs), a nominal current may be run through those LED types, a spectrum may be collected. More specifically, a reading, or calculation, for $X_R(T1)$, $Y_R(T1)$, and $Z_R(T1)$ is collect for the spectrum of light that is emitted with the application of the nominal current applied to the selected type of LEDs.

The X, Y and Z values captured for the light being emitted by the light engine 200 are measurements in accordance with the International Commission (CIE) 1931 XYZ color space. The human eye with normal vision has three kinds of cone cells that sense light, having peaks of spectral sensitivity in short ("S", 420 nm-440 nm), middle ("M", 530 nm-540 nm), and long ("L", 560 nm-580 nm) wavelengths. These cone cells underlie human color perception in conditions of medium and high brightness; in very dim light color vision diminishes, and the low-brightness, monochromatic "night vision" receptors, denominated "rod cells", become effective. Thus, three parameters corresponding to levels of stimulus of the three kinds of cone cells, in principle describe any human color sensation. Weighting a total light power spectrum by the individual spectral sensitivities of the three kinds of cone cells renders three effective values of stimulus; these three values compose a tristimulus specification of the objective color of the light spectrum. The three parameters, denoted "S", "M", and "L", are indicated using a 3-dimensional space denominated the "LMS color space", which is one of many color spaces devised to quantify human color vision.

Most wavelengths of light stimulate two or all three kinds of cone cell because the spectral sensitivity curves of the three kinds overlap. Certain tristimulus values are thus physically impossible, for example LMS tristimulus values that are non-zero for the M component and zero for both the L and S components. Furthermore, LMS tristimulus values for pure spectral colors would, in any normal trichromatic additive color space, e. g. the RGB color spaces, imply negative values for at least one of the three primaries because the chromaticity would be outside the color triangle defined by the primary colors. To avoid these negative RGB values, and to have one component that describes the perceived brightness, "imaginary" primary colors and corresponding color-matching functions are formulated. The CIE 1931 color space defines the resulting tristimulus values, in which they are denoted by "X", "Y", and "Z"

For the collected spectrum, both the resistance (ohms) (referred to a NTC value), and the temperature of light engine 200 is also measured and recorded. In some examples, for the purposes of calibrating the controller 28, the temperature of the light engine 200 may be measured using a thermal probe. This may be referred to as the initial temperature ($T_0$). In some embodiments, a calibrated thermal probe can be used to calibrate the NTC. However, in some embodiments this is not necessary, as long as a relationship between optical characteristics and NTC values is established.

After the initial measurement at the initial temperature ($T_0$) of the spectrum and the resistance of the thermistor sensing setup, or thermistor sensor 100, the temperature of the light engine 200 is increased in increments (e.g., T1, T2, T3 . . . T10), and for each increment in temperature the nominal current is applied to the LEDs of the light engine 200, and the spectrum emitted from the light emitting diodes is captured. More specifically, in some examples, for each increment of temperature (e.g., T1, T2, T3 . . . T10), a reading, or calculation, for $X_R$, $Y_R$, and $Z_R$ ($X_R(T2)$, $Y_R(T2)$, $Z_R(T2)$, . . . $X_R(T10)$, $Y_R(T10)$, $Z_R(T10)$) is collected, as well as a resistance, e.g., NTC value, is measured and recorded from the thermistor sensing setup, or thermistor sensor 100. This can provide $X_R(T)$, $Y_R(T)$, $Z_R(T)$ as function of temperature (T).

This same procedure can be repeated for each color type of light emitting diodes (LEDs) in the light engine 200. For example, as discussed above, the X, Y and Z values of color spectra are first measured for the red light emitting diodes (LEDs), to provide $X_R(T)$, $Y_R(T)$, $Z_R(T)$ as function of temperature (T). However, following characterization of the red LEDs, the same procedure is applied to the other color LED types in the light engine, such as the green (G) LEDs, Blue (B) LEDs and/or Mint (M) LEDs. When the light engine 200 includes red, green, blue and mint LEDs, the process sequence can provide the X, Y, Z values for each LED color type, as a function of temperature, e.g., $X_R(T)$, $Y_R(T)$, $Z_R(T)$; $X_G(T)$, $Y_G(T)$, $Z_G(T)$; $X_B(T)$, $Y_B(T)$, $Z_B(T)$; and $X_M(T)$, $Y_M(T)$, $Z_M(T)$.

The number of temperature increments, and the number of color types of the light emitting diodes (LEDs) may be varied. In the example described above, the number of LED types may be equal to four, e.g., red (R), green (G), blue (B), and mint (M), while the number of temperature (T) increments is equal to 10. As the spectrum characteristics include X, Y and Z values, the total number of values for this example is equal to 120. For this example, these 120 numbers may be stored in the memory, e.g., memory 240, of the controller 28, e.g., flash memory of the controller 28, and can provide the basis for color control. More specifically, the X, Y and Z values for the different LED color types that are stored in the memory of the controller 28 for different temperatures may be used when the thermistor sensing setup, or thermistor sensor 100, detects temperature changes experienced by the light engine 200 during operation of the lighting device 1000, so that the LED characteristics can be adjusted during operation to provide the desired lighting conditions in all temperatures.

Once the X, Y and Z values (also referred to as light calibration values) are defined as a function of temperature (T) for each of the LED types in the light source (e.g., light engine 200), and stored in the memory of the controller 28, the lighting device, e.g., lamp, may use those calibration values during operation of the light to ensure that in all temperature conditions during proper operation the desired lighting characteristics are emitted by the lighting device, e.g., lamp 1000.

During operation of the lighting device, e.g., lamp 1000, for a given color type light emitting diode (LED) (X, Y) and a measured resistance (NTC value) for the temperature (T) of operation, the max current to the light emitting diode (LED) is fixed. Using the same light emitting diodes (LEDs) that were employed in calibration, a red type light emitting diode can have a max current of approximately 510 mA, a lime colored LED type can have a max current per color of approximately 410 mA, a blue colored LED type can have a max current per color of approximately 200 mA, and a green colored LED type can have a max current of approximately 340 mA. In some embodiments, setting a max current provides that the system does not go beyond the current limit set by the driver.

There is a determination of what mode of operation that the lighting device is operating in according to which portion of the CIE 1931 color space chromaticity diagram. FIG. 6 depicts a CIE 1931 color space chromaticity diagram. The outer curved boundary is the spectral (or monochromatic) locus, with wavelengths shown in nanometers. If operating in the bottom portion of the triangle for the CIE 1931 color space chromaticity diagram, the mode of operation is Mint-Red-Blue for the led types in the light engine 200. When operating in the top of the triangle for the CIE 1931 color space chromaticity diagram, the mode of operation is Green-Mint-Blue for the led types in the light engine 200. FIG. 6 includes a data plot within the Mint-Red-Blue triangle.

Operation continues with calculating the pulse width modulation (PWM) for the different types of light emitting diodes (LEDs) under the operation temperature (T). In this example, there are three different LED types. For example, from FIG. 6 the lamp is operating in the Mint-Red-Blue triangle of the CIE 1931 color space chromaticity diagram, and therefore may include LEDs of the mint, red and blue color types.

In some embodiments, the procedure to calculate PWM for three LEDs under temperature T may include the following calculations using equations (1)-(4). The input targets may be CIE_x, CIE_y, and flux, as denoted as x, y, Φ, respectively. The known functions are the tristimulus functions of the bluish white, mint, and amber LEDs at 100% PWM operation and temperature T, as follows:

$X_B(T)$, $Y_B(T)$, $Z_B(T)$
$X_M(T)$, $Y_M(T)$, $Z_M(T)$
$X_A(T)$, $Y_A(T)$, $Z_A(T)$

The aforementioned known functions can be made available by the calibration described above for each of the LED color types as a function of temperature. The calculation may include equation set (1):

$$Y = \frac{\Phi}{683}$$

-continued $$X = \frac{\Phi}{683}\frac{x}{y}$$

$$Z = \frac{\Phi}{683}\frac{1-x-y}{y}$$

The values for Y, X and Z that can be calculated from equation set (1), can then be employed in calculating the PWM values as a function of temperature (T), as illustrated in equations (2). (3) and (4). Equation (2) is the PWM calculation for bluish white light (B) as a function of temperature, and is as follows:

$$PWM_B(T) = \frac{\begin{array}{c} X(Y_M(T)Z_A(T) - Y_A(T)Z_M(T)) + \\ Y(Z_M(T)X_A(T) - Z_A(T)X_M(T)) + \\ Z(X_M(T)Y_A(T) - X_A(T)Y_M(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}} \quad \text{Equation (2)}$$

Equation (3) is the PWM calculation for mint light (M) as a function of temperature, and is as follows:

$$PWM_M(T) = \frac{\begin{array}{c} X(Y_A(T)Z_B(T) - Y_B(T)Z_A(T)) + \\ Y(Z_A(T)X_B(T) - Z_B(T)X_Z(T)) + \\ Z(X_A(T)Y_B(T) - X_B(T)Y_A(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}} \quad \text{Equation (3)}$$

Equation (4) is the PWM calculation for amber light (A) as a function of temperature, and is as follows:

$$PWM_A(T) = \frac{\begin{array}{c} X(Y_B(T)Z_M(T) - Y_M(T)Z_B(T)) + \\ Y(Z_B(T)X_M(T) - Z_M(T)X_B(T)) + \\ Z(X_B(T)Y_M(T) - X_M(T)Y_B(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}} \quad \text{Equation (4)}$$

Equations (2)-(4) are employed by the application to determine the PWM values applied to each LED type to provide the appropriate light characteristics of light selected by the user to be projected by the light engine, as a function of temperature. For the purposes of completion, the derivation of Equations (2)-(4) is as follows:

$$x = \frac{X}{X+Y+Z};\ y = \frac{Y}{X+Y+Z};\ z = \frac{Z}{X+Y+Z}$$

For a certain (x, y, Φ) target $$Y = \frac{\Phi}{683}$$

$$X = \frac{\Phi}{683}\frac{x}{y}$$

-continued $$Z = \frac{\Phi}{683}\frac{1-x-y}{y}$$

Assume the bluish white, mint, and amber LEDs at 100% PWM operation and temperature T have the tri stimulus values $X_B(T)$, $Y_B(T)$, $Z_B(T)$ $X_M(T)$, $Y_M(T)$, $Z_M(T)$ $X_A(T)$, $Y_A(T)$, $Z_A(T)$ In view of the above, the following equations are solved:

$$PWM_B(T)\times X_B(T) + PWM_M(T)\times X_M(T) + PWM_A(T)\times X_A(T) = X$$

$$PWM_B(T)\times Y_B(T) + PWM_M(T)\times Y_M(T) + PWM_A(T)\times Y_A(T) = Y$$

$$PWM_B(T)\times Z_B(T) + PWM_M(T)\times Z_M(T) + PWM_A(T)\times Z_A(T) = Z$$

Or $$[PWM_B(T)\ PWM_M(T)\ PWM_A(T)]\begin{bmatrix} X_B(T) & Y_B(T) & Z_B(T) \\ X_M(T) & Y_M(T) & Z_M(T) \\ X_A(T) & Y_A(T) & Z_A(T) \end{bmatrix} = [X\ Y\ Z]$$

Therefore:

$$[PWM_B(T)\ PWM_M(T)\ PWM_A(T)] = [X\ Y\ Z]\begin{bmatrix} X_B(T) & Y_B(T) & Z_B(T) \\ X_M(T) & Y_M(T) & Z_M(T) \\ X_A(T) & Y_A(T) & Z_A(T) \end{bmatrix}^{-1} =$$

$$\frac{[X\ Y\ Z]}{det\left(\begin{bmatrix} X_B(T) & Y_B(T) & Z_B(T) \\ X_M(T) & Y_M(T) & Z_M(T) \\ X_A(T) & Y_A(T) & Z_A(T) \end{bmatrix}\right)}\begin{bmatrix} Y_M(T)Z_A(T) - Y_A(T)Z_M(T) & Z_M(T)X_A(T) - Z_A(T)X_M(T) & X_M(T)Y_A(T) - X_A(T)Y_M(T) \\ Y_A(T)Z_B(T) - Y_B(T)Z_A(T) & Z_A(T)X_B(T) - Z_B(T)X_A(T) & X_A(T)Y_B(T) - X_B(T)Y_A(T) \\ Y_B(T)Z_M(T) - Y_M(T)Z_B(T) & Z_B(T)X_M(T) - Z_M(T)X_B(T) & X_B(T)Y_M(T) - X_M(T)Y_B(T) \end{bmatrix}^T =$$

$$\frac{[X\ Y\ Z]}{det\left(\begin{bmatrix} X_B(T) & Y_B(T) & Z_B(T) \\ X_M(T) & Y_M(T) & Z_M(T) \\ X_A(T) & Y_A(T) & Z_A(T) \end{bmatrix}\right)}\begin{bmatrix} Y_M(T)Z_A(T) - Y_A(T)Z_M(T) & Y_A(T)Z_B(T) - Y_B(T)Z_A(T) & Y_B(T)Z_M(T) - Y_M(T)Z_B(T) \\ Z_M(T)X_A(T) - Z_A(T)X_M(T) & Z_A(T)X_B(T) - Z_B(T)X_A(T) & Z_B(T)X_M(T) - Z_M(T)X_B(T) \\ X_M(T)Y_A(T) - X_A(T)Y_M(T) & X_A(T)Y_B(T) - X_B(T)Y_A(T) & X_B(T)Y_M(T) - X_M(T)Y_B(T) \end{bmatrix}$$

Therefore:

$$PWM_B(T) = \frac{\begin{array}{c} X(Y_M(T)Z_A(T) - Y_A(T)Z_M(T)) + \\ Y(Z_M(T)X_A(T) - Z_A(T)X_M(T)) + \\ Z(X_M(T)Y_A(T) - X_A(T)Y_M(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}}$$

$$PWM_M(T) = \frac{\begin{array}{c} X(Y_A(T)Z_B(T) - Y_B(T)Z_A(T)) + \\ Y(Z_A(T)X_B(T) - Z_B(T)X_Z(T)) + \\ Z(X_A(T)Y_B(T) - X_B(T)Y_A(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}}$$

-continued $$PWM_A(T) = \frac{\begin{array}{c} X(Y_B(T)Z_M(T) - Y_M(T)Z_B(T)) + \\ Y(Z_B(T)X_M(T) - Z_M(T)X_B(T)) + \\ Z(X_B(T)Y_M(T) - X_M(T)Y_B(T)) \end{array}}{\begin{array}{c} X_B(T)(Y_M(T)Z_A(T) - Y_A(T)Z_M(T)) + \\ Y_B(T)(Z_M(T)X_A(T) - Z_A(T)X_M(T)) + \\ Z_B(T)(X_M(T)Y_A(T) - X_A(T)Y_M(T)) \end{array}}$$

After formulating equations (2)-(4) for measuring the pulse width modulation (PWM) values for the different LED types, it can then be determined if the current or max power for the light engine is reached during operation of the lighting device, e.g., lamp. The pulse width modulation values may be determined first without considering the current and power limits. Thereafter, using equation (5) if it is determined the PWM values result in a power or current that is over the limit, the PWM values can be scaled back until the appropriate current and power is provided.

In one example, the max current is approximately 300 mA, and the max power is 9.5 watt. The max current can be calculated from equation (5), as follows:

$$\text{Current}=\Sigma(\text{Imax_}n*\text{PWN_}n) \qquad \text{Equation (5):}$$

The max power can be calculated from equation (6), as follows:

$$\text{Power}=\Sigma(\text{Imax_}n*\text{PWM_}n*V_n)/\text{Electric_Eff} \qquad \text{Equation (6):}$$

In a following step, 100% dimming is defined at this temperature and color. The color is Cx and Xy, as picked by the user from the color chart. The temperature is the measured temperature. If the limit is reached, scale back all PWMs to safe level. The safe level will be referred to as 100%. If the limit is not reached, find the 100% level. Read Dimming input. Dim based on 100% level defined in (5). If the limit is exceeded, the three pulse with modulation values may be rescaled.

From equations (2)-(6), a program (e.g., provided in the application 244) can be provided for the controller 28 that monitors the thermistor sensing setup, or thermistor sensor 100. The program measured resistance changes in the thermistor sensing setup, or thermistor sensor 100, and correlates those changes to temperature (T). The program in response to changes in temperatures, adjusts pulse width modulation (PWM) settings to change the characteristics of light being emitted by the light engine 200 to ensure that the light being emitted from the light engine 200 matches the desired light characteristics at any temperature (T). The program of the controller 28 should run iterations. The program of the controller 28 should monitor the temperature (T) and adjust PWM continuously. For example, the controller 28 can run iterations once per 1-5 minutes.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs.

Having described preferred embodiments of a LIGHT EMITTING DIODE LUMINAIRES WITH TEMPERATURE FEEDBACK, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method of controlling characteristics of light being projected from a light source comprising:

selecting a color setting of light being projected by a light engine having at least one amber light emitting diode, wherein the light engine includes a printed circuit board having a metal core that is in direct contact with the at least one amber light emitting diode;

monitoring temperature of the light engine with a thermistor, wherein changes in resistance measurements taken from the thermistor are correlated to changes in the temperature of the light engine, wherein the thermistor is also on the printed circuit board of the light engine, and the thermistor is in direct contact with the metal core of the printed circuit board, the thermistor being in direct contact with a same metal core on a same printed circuit board as the at least one amber light emitting diode; and setting characteristics of the electrical signal to energize the amber light emitting diodes of the light engine to provide the color setting selected at the temperature of the light engine measured using the thermistor, wherein setting characteristics of the electrical signal includes adjusting current through pulse width modulation (PWM) according to:

$$PWM_A(T) = \frac{X(Y_B(T)Z_M(T) - Y_M(T)Z_B(T)) + Y(Z_B(T)X_M(T) - Z_M(T)X_B(T)) + Z(X_B(T)Y_M(T) - X_M(T)Y_B(T))}{X_B(T)(Y_M(T)Z_A(T) - Y_A(T)Z_M(T)) + Y_B(T)(Z_M(T)X_A(T) - Z_A(T)X_M(T)) + Z_B(T)(X_M(T)Y_A(T) - X_A(T)Y_M(T))}$$

where PWM is the pulse width modulation, T is temperature, X, Y and Z are coordinates on the International Commission (CIE) 1931 XYZ color space for A is amber, M is mint and B is blue.

2. The method of claim 1, wherein the thermistor can sense temperature ranging from −55° C. to 200° C.

3. The method of claim 1, wherein the lighting characteristic is color.

4. The method of claim 3, wherein the color is characterized by the X, Y, and Z scale values of the International Commission (CIE) 1931 XYZ color space.

5. The method of claim 1, wherein the electrical signal to energize the amber light emitting diodes is a pulse width modulation value.

6. The method of claim 1, wherein the at least one amber light emitting diode of the light engine includes a plurality of strings of light emitting diodes.

7. The method of claim 1, wherein each string of said plurality of strings of amber light emitting diodes includes LEDs that project a different color.

* * * * *